US008776535B1

(12) United States Patent
Bernert, Jr. et al.

(10) Patent No.: US 8,776,535 B1
(45) Date of Patent: Jul. 15, 2014

(54) AMBIENT AIR VAPORIZER FOG DISPERSAL SYSTEM

(76) Inventors: Robert E. Bernert, Jr., Dartmouth, MA (US); Robert E. Bernert, Sr., Dartmouth, MA (US)

( * ) Notice: Subject to any disclaimer, the term of this patent is extended or adjusted under 35 U.S.C. 154(b) by 0 days.

(21) Appl. No.: 13/507,494

(22) Filed: Jul. 5, 2012

Related U.S. Application Data

(60) Provisional application No. 61/572,094, filed on Jul. 11, 2011.

(51) Int. Cl.
*F17C 9/02* (2006.01)

(52) U.S. Cl.
USPC ..... 62/50.2

(58) Field of Classification Search
CPC ..... F17C 2227/0311; F17C 2227/0313; F17C 2227/0393; F17C 2250/046; F17C 2260/04
USPC ..... 62/50.2; 60/641.8, 641.12, 641.13, 651
See application file for complete search history.

(56) References Cited

U.S. PATENT DOCUMENTS

| | | | | |
|---|---|---|---|---|
| 2,969,920 | A | 1/1961 | Giannoni | |
| 3,965,672 | A | 6/1976 | Stephens | |
| 3,978,663 | A | 9/1976 | Mandrin | |
| 4,184,417 | A * | 1/1980 | Chancellor | 454/40 |
| 4,226,605 | A * | 10/1980 | Van Don | 62/50.2 |
| 4,329,842 | A | 5/1982 | Hoskinson | |
| 4,331,129 | A | 5/1982 | Hong et al. | |
| 5,291,738 | A | 3/1994 | Waldrop | |
| 5,390,500 | A | 2/1995 | White | |
| 7,137,623 | B2 | 11/2006 | Mockry et al. | |
| 7,493,772 | B1 * | 2/2009 | Brown | 62/50.2 |
| 7,870,747 | B1 * | 1/2011 | Brown | 62/50.2 |
| 2002/0159942 | A1 | 10/2002 | Jessup | |
| 2007/0017232 | A1 * | 1/2007 | Brown | 62/50.2 |
| 2007/0144184 | A1 | 6/2007 | Wijingaarden | |
| 2007/0214804 | A1 | 9/2007 | Hannan | |
| 2008/0250795 | A1 | 10/2008 | Katdare | |
| 2009/0165468 | A1 | 7/2009 | Wiindaarden | |
| 2009/0211263 | A1 | 8/2009 | Coyle | |
| 2012/0193075 | A1 * | 8/2012 | Reese et al. | 165/104.11 |

FOREIGN PATENT DOCUMENTS

DE 102009039896 A1 * 3/2011

* cited by examiner

*Primary Examiner* — John F Pettitt
*Assistant Examiner* — Tareq Alosh
(74) *Attorney, Agent, or Firm* — Robert J Doherty

(57) ABSTRACT

A method for eliminating ground fog which results from vaporizing cryogenic fluids using ambient air. The method includes the steps of drawing an ambient air stream through an ambient air vaporizer thereby cooling the air stream and vaporizing the cryogenic fluid, and then passing the cooled air stream through a vent stack. The method further includes isolating the inlet air stream from the cold outlet air stream and dispersing the cold air into the atmosphere upon leaving the stack. The method further controls the relationship of the stack exit location and the ambient air vaporizer to prevent a temperature depression in the air surrounding the vaporizer which depression causes reduced vaporizer performance.

3 Claims, 5 Drawing Sheets

Ambient Vaporizer Array with Fog Dispersal System (Plan View)

(Elevation)

Ambient Vaporizer Array with
Fog Dispersal System (Plume Standard Height and Air Mixing)

Stack and Plume Height are Such that the Combination with Stack Distance from Ds from Array the Plume Exit 16B is Outside of the Solar Insolent Radius Rs. Using Spherical Geometry:

$$R_S = \frac{y^2}{8x} + \frac{X}{2}$$

Where Rs = Solar Radius Hemisphere
X = Rs - Ds
Y = Chord L
= 2 x Plume Height (23)
Ds = Stack Distance from Array

[ Solve Equation Gives Stack Location Ds with Known Values of Rs + (23) ]

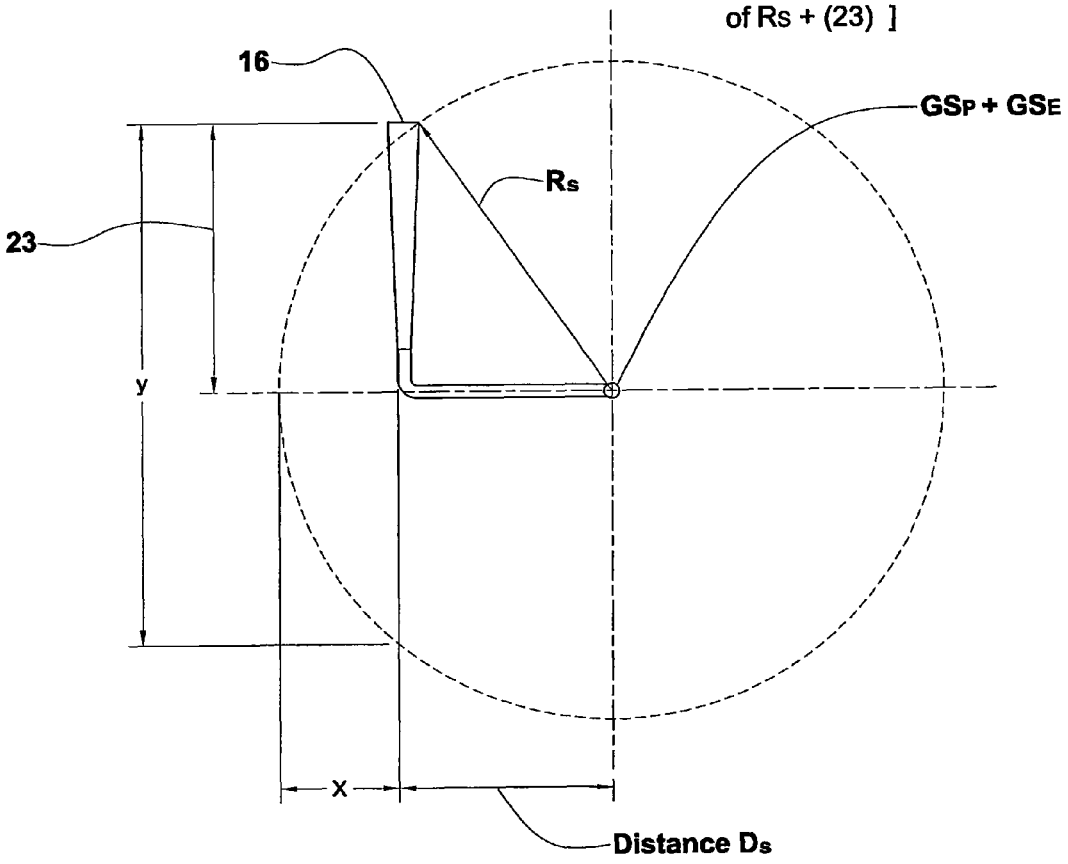

(Stack Location from Array)

FIG. 3

FIGURE 2.21 Average daily total horizontal solar radiation for the month of August in langleys per day. From dejong (2) with permission Langleys per day = cal / $cm^2$ day = 76.8 $BTU/HrFt^2$ From
Principles of Solar
Engineering
by
Krieth and Krieder
Hemisphere Pub. Corp.
Wasington
1978

Periodic Ground Fog Dispersal

Induced Draft Vaporizer with Vertical Plume

AMBIENT AIR VAPORIZER FOG DISPERSAL SYSTEM

We claim the Benefit of Provisional Patent Application 61/572,094 filed Jul. 11, 2011

BACKGROUND OF THE INVENTION

The present embodiments generally relate to the vaporization of cryogenic fluids such as oxygen, nitrogen and liquefied natural gas (LNG) using ambient air vaporizers and to control atmospheric fog that is generated by the exiting cold air stream as it mixes with the surrounding humid ambient air.

As the need for larger cryogenic vaporizer systems has developed and the advantage of obtaining the required heat for the vaporization process from the ambient air has been recognized multiple arrays of ambient air vaporizers are employed and have been found to create fog banks which are both objectionable and hazardous.

It has further been found that large arrays of ambient air cryogenic fluid vaporizers have the potential to cool a large body of the ambient air surrounding the vaporizers on calm, no wind days. Since the ambient air vaporizers require a supply of the warmer ambient air, the cool air, since it is heavier than the surrounding warmer air tends to sink or travel to the ground where if mixed with surrounding warm air as it enters the vaporizer, will reduce vaporizer performance.

Prior ambient air cryogenic vaporizer art, such as, Brown in U.S. Pat. No. 7,870,747B1, Jan. 18, 2011; Brown in U.S. Pat. No. 7,493,772B1, Feb. 24, 2009; Coyle in US APPL 2009/0211263A1; White in U.S. Pat. No. 5,390,500, 2/1995 and Vogler in U.S. Pat. No. 4,399,660, 8/1983 do not appreciate the natural downward flow direction of the cooling ambient air which is heavier than the surrounding mass of the warmer ambient air. The cooler, heavier air forms a "ground air layer" beneath the moist warmer air, thus forming a ground fog as the cool lower air layer cools the warmer upper layer forming a fog bank at ground level where it is considered hazardous, while at the same time the cool air collecting around the vaporizer will considerably reduce performance to unacceptable levels.

As the arrays of ambient air vaporizers have become larger, so to has the height of the vaporizer increased to provide as much vaporization capacity into as small a plot space as possible. One method to save space has been to use ducted ambient air vaporizers which employ fans or blowers to force the required air over the vaporizing, finned tubular heat exchange elements. These high velocity fans require considerable and costly power which reduces the benefit of the ambient vaporizer over energy consuming heated type vaporizers.

For the foregoing reasons there is a need for an ambient air vaporizer system which well reduce or eliminate fog, which will preclude the recycling of cooled air into the warm entering air stream to the vaporizer array and will permit the free flow of air through the vaporizer system and in certain cases to provide an induced draft warm ambient air supply to the vaporizer array to enhance the air flow through the system and increase vaporizer capacity.

SUMMARY OF THE INVENTION

The needs outlined above may be met by the present invention, wherein the fog producing aspects of large ambient vaporizer arrays are reduced or eliminated and the cold air exiting at the base of the vaporizer array is ducted away and above the ambient air entering at the top of the array of ambient vaporizers.

The steps of the basic method include: drawing a stream of ambient air into the array of ambient vaporizer heat exchangers, then transferring heat from the ambient air stream into the cryogenic fluid as it passes through the heat exchange elements of the ambient air vaporizer, collecting the naturally downward flowing dense cold air stream at the open space beneath the vaporizers, discharging the cooled air stream from the beneath the vaporizer array; isolating the inlet air stream from the outlet air stream, and providing a vertical, upward discharge plume of the dense exit cold air stream having sufficient velocity to propel it upward to reduce or eliminate ground fog as the cooled air mixes with the ambient air surrounding the upward flowing cold air plume.

In one embodiment, the ambient vaporizer array is positioned in a specific pattern of rows and lanes with the vaporizers mounted on air extended base (according to patent application Ser. No. 11/810,172 filed Jun. 2, 2007) and now U.S. Pat. No. 8,069,678 and application Ser. No. 13/317,753 filed Oct. 27, 2011 to provide a supply of warm air to flow downward through the ambient vaporizers and freely exiting at the vaporizer base area. The disclosures of the above patent, application Ser. No. 11/810,172 and Ser. No. 13/317,753 are hereby incorporated herein by specific reference thereof.

In one embodiment of the invention a vertical containment barrier or berm is provided at the base of the vaporizers such that the berm surrounds the vaporizer array to collect the naturally downward flowing cold air to prevent it from mixing with the moist warm air surrounding the vaporizer that is, the moist warm air outside of such barrier, and allow the collected air within the barrier to be discharged up away from the vaporizer array using fans or blowers. The cold air discharge from the fans is conducted upward and away from the array at a particular distance to prevent the cold air from forming a temperature depression at the vaporizer and reentering the vaporizer array as such reentering cold air would reduce vaporizer performance.

In another embodiment a vertical discharge duct or chimney is added to the fan discharge duct of the aforementioned embodiment to discharge the cold air at a height at or above the level at which top warm air enters to the vaporizer array and providing a high velocity vertical plume of cold air where the cold air mixes and is warmed as it rises via the plume into the warm ambient air, thereby reducing or eliminating fog formation.

In still another embodiment a converging exit cone (FIG. 2A, 25) is provided at the top of the aforementioned vertical discharge duct to increase the exit velocity $V_D$ (FIG. 2A) and also the height of the plume to increase mixing and further separate the cold discharge from the warm humid air stream entering at the top of the ambient vaporizer array.

In yet another embodiment the plume height from the exit vertical duct is such that when combined with the duct distance from the array that the distance from the array entry point to the top of the cold exit plume is equal to or greater than the radius of a sphere wherein one half of the surface area of the sphere multiplied by the local daily mean of total solar radiation (FIG. 4) is equal to the energy required to heat the cold air discharge to or above the dew point of the surrounding ambient air, thus preventing ground fog. Such use of solar energy for "cold" fluid vaporization, is outlined in Hong et al U.S. Pat. No. 4,331,129, 1982 which uses shallow solar ponds to collect the daily solar flux (Col 6, lines 20-40) to supply all or part of the energy required for vaporizer heat exchangers.

In yet another embodiment the capacity of the cold air discharge rate of the fans is greater than the natural convention free air flow rate exiting out the base of the vaporizer array, thereby creating an induced draft effect on the cold air stream as it flows downward over the vaporizers to improve vaporizer array performance and improve fog mitigation.

In yet another embodiment, the upward vertically discharge fan is positioned directly above the vaporizer, while this is an unobvious location since the fan must reverse the natural downward direction of flow of the cool, dense air, the advantage is that a berm is not required to collect the cold air which otherwise would form at the base level of the vaporizer. Such fan discharge being sufficient to overcome the "cold downdraft" created by the cryogenic vaporizer heat transfer process and to provide the discharge velocity required to produce the plume height which allows sufficient mixing of the cold rising plume with the warm air surrounding the plume to prevent fog bank formation. Unexpectedly, since the volume of air pulled thru the fan is a combination of the vaporizer natural draft air and excess warm air, the combination provides a higher air velocity and a warmer plume exit temperature. The higher velocity improves vaporizer heat transfer performance and the warmer average plume exit temperature reduces fog formation potential.

In yet another embodiment, where it is desired to maintain both the natural convection ambient air vaporization process and disperse fog periodically, particularly on a small number of vaporizer modules, the fan location is positioned at the vaporizer open area (E.g. FIG. 5) such that the naturally downward flow of cooling air is pulled directly into the fan intake and then vertically discharged into the stack, and with the stack exit being far enough above the air flow intake at the vaporizer top so as to avoid recirculation of cooled air back down into the vaporizer module. In this embodiment the containment barrier or wall 9 (FIG. 1) is not employed, as such wall, during periods when fans are not operating, would prevent the free flow of cooled air from beneath the vaporizer, which would "stall" the vaporizer process. Without employing the containment barrier or wall 9 (FIG. 1) this present embodiment, when the dispersal fan is not in use, the natural convection ambient air vaporizer process is not impeded by such barrier. The air intake to the fan may be on only one of the four open spaces beneath the vaporizer with enough fan intake air velocity to capture the cold, fog forming natural convection air stream as it flows down into the open space beneath the vaporizer module or modules. Under certain conditions, depending on the width of the vaporizers and the height of the vaporizer heat exchange elements, the dispersal fan is installed directly above the vaporizer providing a more compact arrangement. In this case, those skilled in the art realize that the fan intake velocity profile needs to be sufficient to reverse the natural downward cooling air stream to pull the fog forming cool air up though the vaporizer, into the fan and subsequent dispersal via stack and plume having a plume exit distance from the vaporizer sufficient to prevent air recirculation. To assist this air intake air stream an air entry control duct may be added on the four exterior sides of the vaporizer and extend partially or fully down the vaporizer exterior, (FIG. 5-1).

In formulating a fog dispersal method for large arrays of cryogenic natural convection ambient air vaporizers, it surprisingly different than prior "cooling tower" and "chimney effect" stack art due to the NEGATIVE natural draft created by the air cooling process which occurs.

Further since for long term continuous operation, large volumes of cold air are continuously being formed. If these cold volumes of air are not continuously removed from the area surrounding the vaporizers, a temperature inversion may occur in the area. Such temperature inversion, which sometimes occurs naturally under certain meteorological conditions, upset the natural normal air convection via the heavier colder air tending to remain at low level. Without the natural convection process created by the "normal" atmospheric temperature profile (i.e. warmer at ground level and cooler as the altitude increases), the cooler "stagnant" air remains at ground level. Hence, surprisingly, a large array of continuously operating air cooling vaporizer can create its own temperature inversion with corresponding dense fog, unless the cold body of air is dispersed and "warmed back up" using the natural means of this invention. Moreover, this cold layer reduces the performance of the vaporizers which rely on a continuous supply of warmer entering air.

There are, of course, additional embodiments of the invention which will be outlined below and which are for the purpose of description and should not be regarded as limiting.

BRIEF DESCRIPTION OF THE DRAWINGS

FIG. 1 is an overall view of the ambient vaporizer array with fog dispersal system of the present invention and is comprised of:

*Fig.* 1A which is a side and cross-sectional view thereof, and

Figures 1, 1A, 1B:
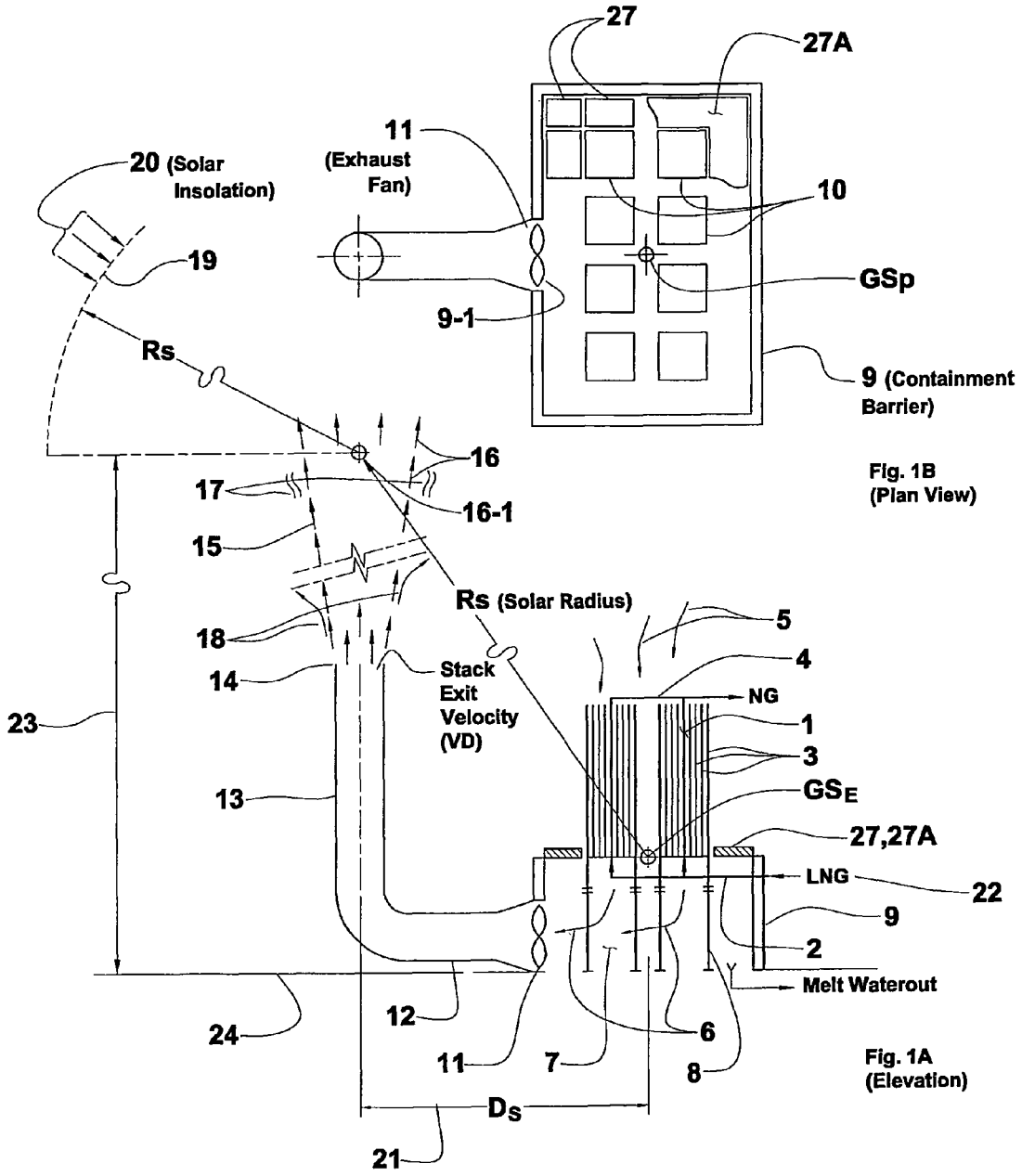
Figure 2:
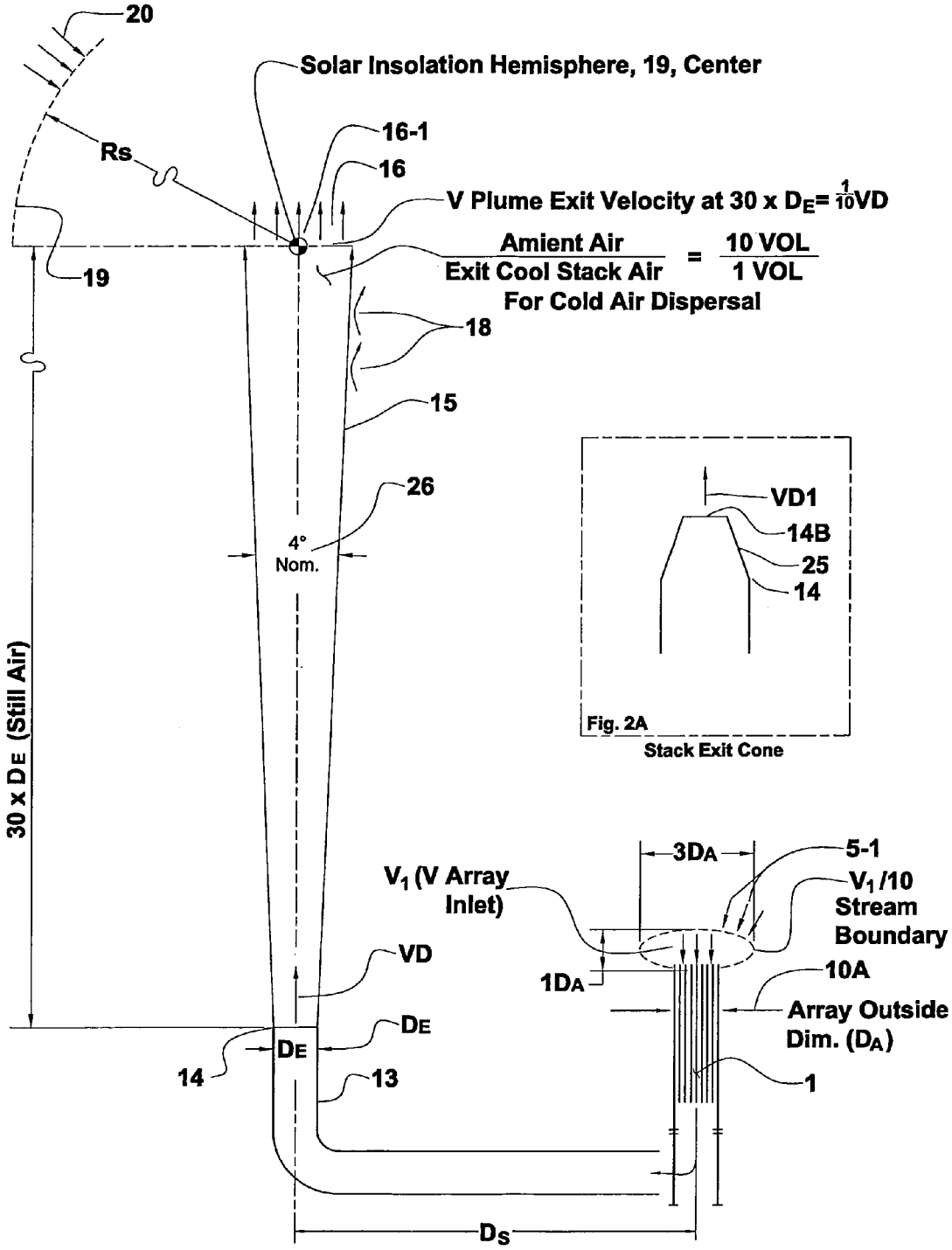
Figure 4:
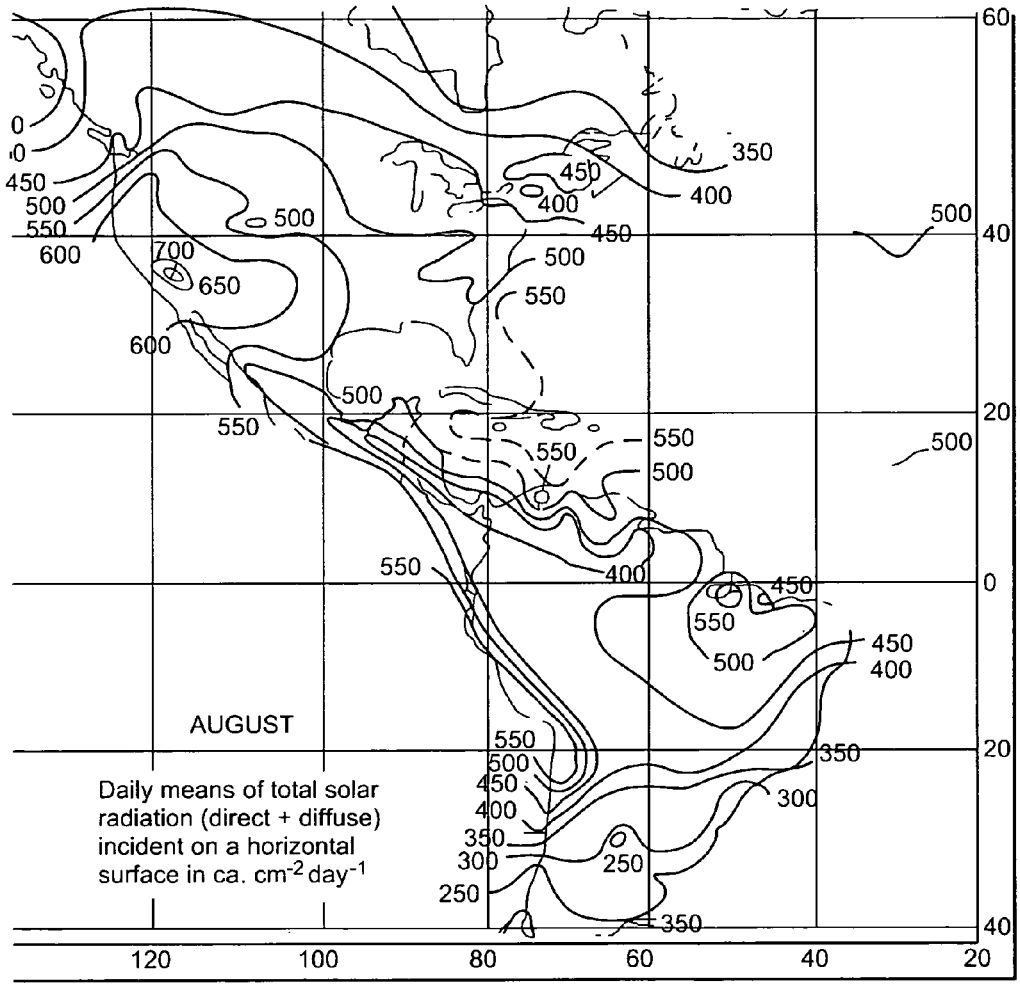
Figure 5:
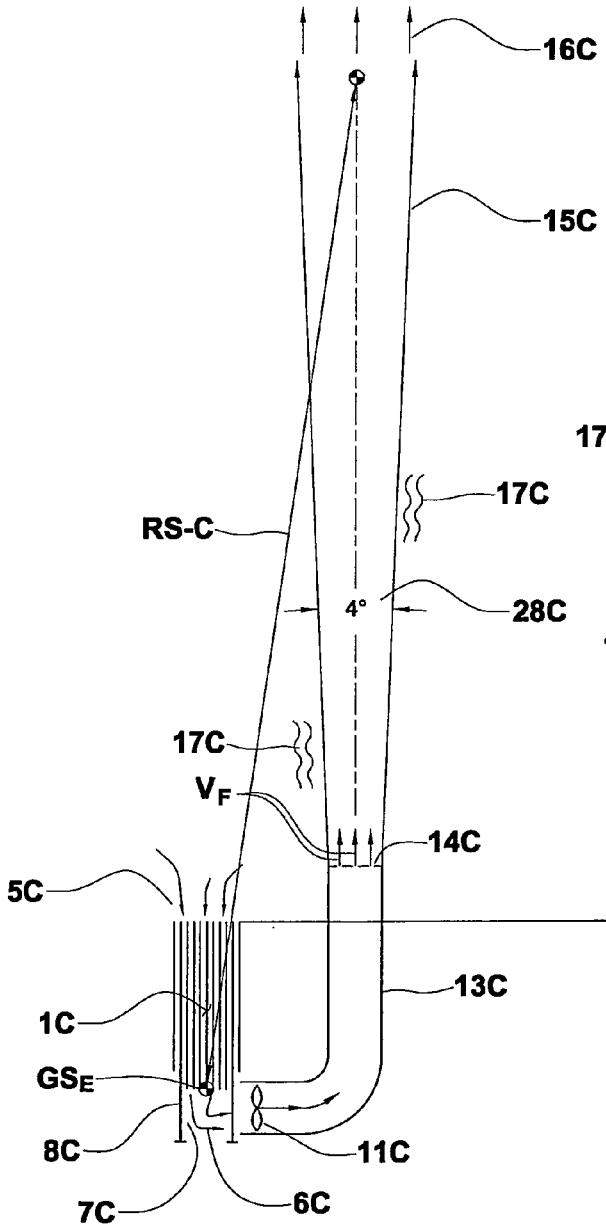
Figures 1, 5:
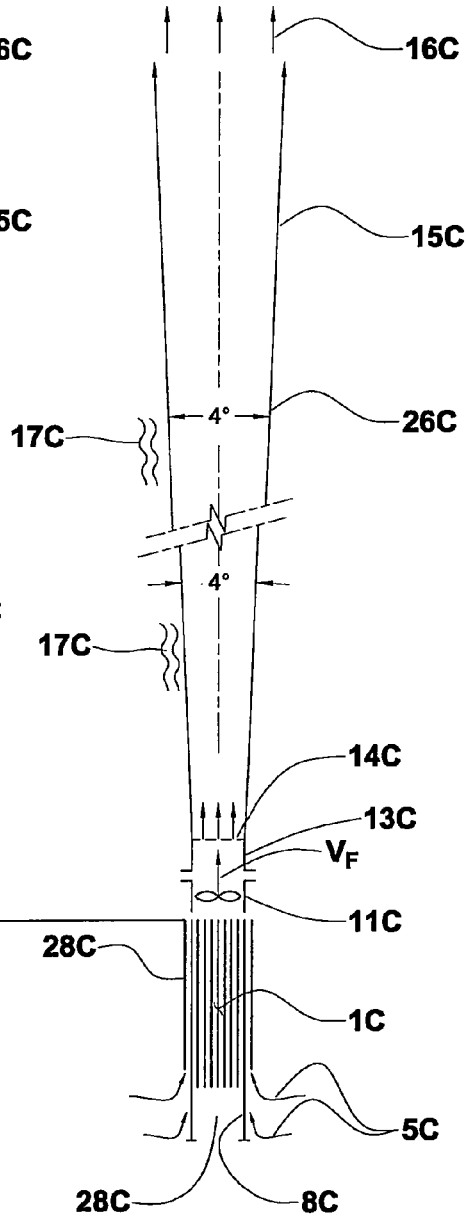

FIG. 1B which is a plan view thereof;

FIG. 2 is a side view a cold air dispersal stack and cold air plume with air inlet and outlet separation distance;

FIG. 2A is an illustration of a stack exit converging cone;

FIG. 3 is a schematic view of cold air plume heating with solar insolation combined with stack height and location;

FIG. 4 is a world plot of the average daily total horizontal solar radiation showing local variations; and FIG. 5 is a general elevation view of an induced draft ambient vaporizer with a top mounted, vertical upward discharge cold air plume.

DETAILED DESCRIPTION

FIG. 1 illustrates an example of an ambient vaporizer fog dispersal system for use on fluids such as cryogenic LNG. An LNG fluid stream (22), at about −260° F. and 1200 psi (pounds per square inch) enters ambient vaporizers (1) via inlet manifold (2) flows upward within ambient heat exchange elements (3) which are typically austenitic stainless steel tubes fitted within and bonded to an outer hollow bore externally finned elongated aluminum extrusion, and where the LNG is warmed and vaporized before exiting heat exchange elements (3) via top cryogenic fluid manifold (4) where the natural gas (NG) is conveyed to downstream use such as entering a natural gas pipeline or for use in a power plant. In operation, warm air (5) enters the uppermost top of the ambient vaporizer (1) where, as it cools and transfers its thermal (heat) energy to the LNG through the finned heat exchange elements (3), it becomes more dense or heavier and therefore, flows naturally downward through the vaporizers (1). Such downward flow is caused by the natural draft created by the difference in density of the cooled or cold, more dense or heavier exit air (6) and the warmer lighter entering air (5), and then exits beneath vaporizers (1) at an open space (7). This open space (7) is created by mounting the vaporizers (1) on extended bases (8) as defined in U.S. patent application Ser. No. 11/810,172 filed Jun. 2, 2007 and now U.S. Pat. No. 8,069,678. The cold air (6) is contained within the open space (7) by a containment barrier or berm (9) formed by walls surrounding vaporizer array 10 and extending to a height to about equal to that of open space 7 (FIG. 1) provided by extended base 8 (FIG. 7) to allow the cold air to be contained and directed away from vaporizer array (10) (FIG. 1B which shows (6) vaporizers (1) forming an array 10) through opening or passageway 9-1 (FIG. 1B) in barrier 9 in a controlled manner by employing cold air discharge means such as fans (11) an air discharge duct (12) and an air dispersal stack or chimney (13). On large vaporizer arrays, multiple fans, ducts and/or stacks may be used to meet the required scale of the system. The cooled or cold air exits the dispersal stack exit (14), at a particular exit velocity ($V_D$) based on the volume of air discharged and the stack exit diameter so as to establish an exhaust plume (15) of sufficient height at cold plume exit (16) to permit cold air to mix with the warmer surrounding air (17) and to prevent the plume air (16) from re-entering the array (10) at the warm air inlet (5). For example, those of ordinary skill using a standard plume rise guide such as ASHRAE Laboratory Design Guide, Equation 9-2, would estimate a cold plume rise of about 30 times the stack exit diameter in still air allowing that the velocity at the cold plume exit 16 (FIG. 1) is 1/10 times the stack exit velocity $V_D$ (FIG. 1). It is understood that local conditions, such as wind velocity, nearby buildings, etc may alter the actual plume geometry. To prevent or mitigate atmospheric fog formation cold plume air (16) and the warmer surrounding air (17) gradually mix at rising plume boundary layer (18), thereby avoiding heavy, fog producing concentrations of warm air condensate or fog which may form during the warm air-cold air mixing process within plume boundary layer (18), when the air mixture within layer (18) has a dew point in excess of 100%.

It is understood that a multi-vaporizer array of ambient air vaporizers (10) will require a sufficient amount of warm ambient air (5) to provide the heat to accomplish vaporization and cryogenic gas warming. For example, the heat required or array thermal duty, in BTU/Hr, which for a typical cryogenic LNG flow of between 4,000,000 and 50,000,000 SCFH (standard cubic feet per hour), when using a large array (10) of tall ambient vaporizers (1) each containing 100 heat exchange elements (3) each 40 feet tall, when transferred from the air to the cryogenic fluid, would cool the naturally downward flowing air by 50 to 100° F., would require about 1,000,000 cubic feet per minute (CFM) to 10,000,000 CFM of warming entering air (5) to the array (10).

In the particular instance where it is desired to induce and/or increase the natural draft of the vaporizer array, fan or fans 11 may have their capacity increased to exhaust a volume of air in excess of the natural draft process. To add control to the increased air flow rate created by this increased air capacity of fans (11), induced air baffles 27 (FIG. 1) or air baffle deck (27A) may be included. The baffles (27) or (27A) prevent the induced draft air from bypassing the natural vaporizer air flow stream (5) and entering the open space beneath vaporizers (1) as a separate bypass stream. With baffles (27) or (27A) in place, the induced draft excess air is forced to join with natural draft air stream (5) flowing down and through ambient vaporizers (1) and exiting as cold and mixed air (6), thusly the induced air adds to the natural air flow through the vaporizers (1). Unexpectedly, this method not only improves vaporizer capacity but reduces the temperature difference between the exhaust plume (15, FIG. 1) and the warm surrounding air (17, FIG. 1) thereby reducing the fog producing potential in the boundary layer (18, FIG. 1).

To prevent cold air (16) from recirculating back to and reentering the array (10) at entry point (5) over an extended period of time, when the ambient air is still, i.e. no wind is blowing, such recirculation reducing vaporizer performance due to its cooling effect, the average solar incidence or solar radiation at the particular array location (FIG. 4) may be used to reheat the cold exit air (16). The solar heating area is defined as a solar insolation hemisphere (19, FIG. 1) whose surface area multiplied by the local solar insolation (20) which insolation is the amount of solar radiation energy received at the surface of the solar hemisphere and is equal to the vaporizer array heat load or $$\frac{\text{ARRAY THERMAL DUTY}}{\text{SOLAR INSOLATION}} = \frac{1}{2}(4\Pi R_S^2)$$

where $R_S$, (FIG. 1) is the solar hemisphere radius, the vaporizer array thermal duty is the amount of thermal energy (e.g. BTU/HR) required to raise the temperature of the entering cryogenic fluid stream (22) from its entering cryogenic temperature to its exit warm temperature at exit manifold (4), and solar insolation is, for example, the average daily total horizontal solar radiation for the particular location of the array, as given for example, from FIG. 4. FIG. 4 is a world map of solar radiation isobars ranging from about 150 to about 650 Langleys per day at different locations on the earth. A Langley per day is equal to cal per square centimeter per hour. Alternatively, 500 Langleys per day from a particular isobar shown on FIG. 4 may be converted to 76.8 BTU/hour/square foot. Solar insolation hemisphere (20) is located such that its geometric center is located at point 16-1 (FIG. 1) and (FIG. 2). It can be now understood that the solar hemisphere will vary in size based on the thermal energy required, the particular solar radiation isobar chosen from FIG. 4 for the location of the vaporizer array and for example local meteorological factors.

To prevent the re-entry or recirculation of cold plume exit air (16) to the array (10) at warm air entry (5), the plume cold exit (16) is positioned away from the array (10) a distance equal to the solar hemisphere radius ($R_S$) as described above and positioned such that, using FIG. 3, the stack may be laterally positioned away from position $G_{SP}$, the geometric center of vaporizer array 10 (FIG. 1B) plan view, and $G_{SE}$ the position or elevation of the geometric center located at the bottom of heat exchange element 3 (FIG. 1A) of FIG. 1A a distance $D_S$ at (21), such distance when combined with plume exit distance (23) satisfies the spherical geometry equation $$R_S = \frac{y^2}{8x} + \frac{x}{2},$$

to form a right triangle, having sides $D_S$ (24, FIG. 1) and distance (23) and hypotenuse $R_S$.

Now referring to FIG. 2, the warm air stream boundary line 5-1 as warm air enters vaporizer 1 at velocity $V_1$. Velocity $V_1$ is determined by array outside dimension 10A, or $D_A$ (FIG. 2), using the vaporizer inlet volume of air required to balance the thermal duty as defined above. Boundary line 5-1 is defined as the air passing through this boundary as being 1/10 of the velocity $V_1$ at the vaporizer entry point $V_1$ (FIG. 2). Recirculation is avoided when solar insolation hemisphere center at 16-1 (FIG. 2) falls outside of warm air stream boundary 5-1 (FIG. 2).

In combination, using the solar radius $R_S$ to establish a minimum dimension to locate plume exit location 16-1 (FIG. 1) to prevent recirculation and again to use the solar radiation hemisphere from plume exit location point 16-1 (FIG. 1) wherein the cold exit distance 23 (FIG. 1), is at a distance from vaporizer base mount level 24 (FIG. 1) assures cold air and fog dispersal below the plume exit point 16-1 (FIG. 1). Without such solar insolation, continued vaporizer operating in still air will cool the surrounding air sufficiently to create fog.

Further consideration of FIG. 3, indicates that when following the tenants of the invention, the plume exit is outside of the solar radius (Rs) as defined above when the surface of the hemisphere 20 (FIG. 1) defined by Rs multiplied by the local solar insolation input as referenced in FIG. 4 for example is equal to the thermal heat requirement or thermal duty of the vaporizer array, and the location of the center of the solar insolation hemisphere is defined as the geometric center of the solar array GSp (FIG. 1B, plan view) in plan view of the array and at elevation $GS_E$ (FIG. 1, elevation view).

In another embodiment of the invention a consideration of certain aspects of the example of FIG. 1, will be made i.e. that the warm moist air inlet (5) and the cold air outlet from the stack (16) will have different temperature differences and different amounts of moisture depending upon atmospheric conditions and vaporizer operating characteristics. As the relative humidity of the warmer inlet air (5) increases and the temperature of the cooled air at the vaporizer air exit (6) decreases the propensity for the air plume mixing boundary layers (18) to produce condensation resulting in fog is increased. Additional fog mitigation is provided in this embodiment by increasing the amount or volume of air which is discharged via the discharge duct (12) beyond that which is solely due to the natural convection process of the ambient air vaporizers as previously defined. Such a process is termed "induced draft" wherein the amount of air is induced to be a greater amount or volume than would flow via the "natural draft" of the vaporizers. Such an induced draft would be created, for example, by increasing the capacity of the fans (11). For example, again referring to FIG. 1, if the warm entering air (5) was 70° F./70% RH (relative humidity) it would have dew point of 60° F., i.e. at below 60° F. condensation fog would occur. If the natural convection ambient air vaporizer array (10) cooled the incoming 70° F. air, for example by 100° F., the exit air (6) would be −30° F., or a temperature difference in exit plume (15) of 100° F. and a 90° F. temperature difference to the dew point when mixed to produce condensation and fog. By causing an induced draft using increased discharge fan (11) capacity of for example twice the natural convection air volume, the air leaving the vaporizer at (7) would be about 40° F. warmer, hence the temperature difference in the plume would be reduced to about 50° F. or nearly half the 90° F. original temperature difference to produce fog. A surprising additional advantage of this embodiment is that the increase in air flow through the vaporizers, due to the induced draft, will increase vaporizer performance by both increasing air velocity and increasing the operating temperature difference between the air and the cryogenic fluid.

FIG. 2 illustrates the relationship between the inlet air (5-1) to the vaporizer (1A), the discharge stack (13) and cold air exhaust plume (15).

Those of ordinary skill in air handling air understand that there is a difference in the air streams at the entrance to an air opening or duct and the air streams at the exit from a duct or stack. Such distances are depicted on FIG. 2, illustrating that for an exit plume velocity ($V_{PLUME}$) at plume exit (16) corresponding to an exit velocity $V_{PLUME}$ of about 1/10 of the stack (13) exit velocity ($V_D$), the height of the plume (15) is about 30 times the stack diameter ($D_E$) in still air or when there is no wind, whereas the entry air 5-1 (FIG. 2) geometry for the same 1/10 velocity ratio as employed for the stack exit velocity, the entry air streams inward to the array at a distance between 1 $D_A$ (FIG. 2) and 3 $D_A$ (FIG. 2), where $D_A$ is the array (10A) equivalent hydraulic diameter defined as those of ordinary skill understand as being equal to $$\frac{4Ac}{P},$$

where Ac is the duct or fluid flow cross sectional area and P is the perimeter of the fluid flow duct. Surprisingly, this results in near zero air disturbance between air at stack exit 14 and the volume of entry air (5-1) indicating that recycling or recirculation of cold exit air from plume 15 into vaporizer array inlet air stream boundary 5-1 (FIG. 2) is essentially eliminated when following the tenants of this invention. Again considering FIG. 2, those skilled in the art will realize that the normal plume expansion cone angle (26) (FIG. 2) is about 4° included angle. With the plume exiting at duct exit 14 at an exit velocity $V_D$ requires boundary layer mixing with warm surrounding air to achieve the 1/10 $V_D$ at plume exit (16). As noted above, entry air 5-1, will typically cool about 50 to 100° F., thus with the boundary layer mixing (18) results in an exit air temperature at (16) of 1/10 the ambient air cooling or about 5 to 10° F. below the ambient air. Since the dew point of 70% $R_H$ of air for example between 70 and 100° F. is about 10° F. below the surrounding warmer ambient air temperature, no condensation or fog will occur external to the plume and hence fog formation will be eliminated or reduced.

In FIG. 2A is shown an illustration of a stack exit converging cone (25) whereby, exit 14B has a smaller air exit area than stack/duct exit 14, hence the normal stack exit velocity is increased at exit 14B to higher velocity $V_{D1}$. Such increase in exit velocity increases plume height as discussed above, providing increased mixing and plume exit distance from the vaporizer array air inlet.

In yet another embodiment, as shown on FIG. 5, the containment barrier 9 (FIG. 1) is not employed, as, for intermittent vaporizer operating when dispersal fan or fans 11C (FIG. 5) is not required to be operated; a containment barrier would stall vaporizer operating by restricting the natural downward air flow. Warm entry air 5C (FIG. 5) enters vaporizer IC and exits as cold exit air 6C in space 7C. A dispersal fan 11C so mounted such that the fan intake draws in cold air 6C which is then conveyed through vertical stack or duct (13C) and discharged at stack exit 14C. To prevent cool plume exit air 16C from recirculating back to warm entry air stream 5C, the plume exit 16C, as similarly shown on FIG. 1 to be at a distance of one solar radius $R_s$-1 (FIG. 5) from the vaporizer $GS_E$ as previously defined.

In another embodiment which does not employ containment barrier 9 (FIG. 1), an induced draft vaporizer with direct vertical updraft is illustrated in FIG. 5-1, wherein the natural downward air flow created by the cooling of the warm air as previously described in FIGS. 1 and 2, is reversed by induced draft fan 11C (FIG. 5-1), which fan creates an updraft in excess of the natural downdraft of FIG. 1, causing warm air 5C (FIG. 5) to enter vaporizer 1C at primarily the open space beneath the vaporizer 1C which space is created by extended base 8C. An air entry control duct 28C (FIG. 5-1) may also be provided not only to reverse the natural downward flow of cooling air but also to increase the air velocity within the vaporizer as the induced air flow travels upward through ambient air vaporizer 1C. This air velocity increase not only improves vaporizer performance but also reduces the temperature difference between air plume 15C as it exits induced draft 11C, and the warm surrounding air (17C, FIG. 5).

In this embodiment, when following the above instruction of FIGS. 1, 2 and 3, the distance $D_s$ (FIG. 3) will be zero resulting in a required plume exit height of about 2 times height 23, FIG. 3, which height is obtained by the increase in induced draft fan 11C (FIG. 5-1) exit velocity $V_F$. The land or vaporizer site area required by this embodiment is smaller and the additional volume of air over the vaporizer provided by the fan reduces the temperature difference between the cold visions plume as described above. Surprisingly, this reduction in air temperature difference between plume air and surrounding air provides less potential moisture condensation in the boundary layer between exhaust plume 15C (FIG. 5-1) and warm surrounding air 17C (FIG. 5-1), and a corresponding reduction in fog formation potential.

As a non-limiting example of an ambient air cryogenic vaporizer system such as embodied in FIG. 1 requiring, for example, an array thermal duty of 630,000,000 BTU/hr of heat transferred from the ambient air to the cryogenic LNG, would require about 360 vaporizer modules arranged in 3 banks of 120 modules each with 2 banks vaporizing and 1 bank in defrost mode, thus providing a continuously operating system. Such alternating operating of larger vaporizer module arrays is described in application Ser. No. 11/810,172 as cited above.

Using the tenants of this invention and the instruction provided by the figures, those of ordinary skill could determine that for an air temperature drop of about 50° F. naturally falling to the space (7, FIG. 1) beneath the vaporizers that, 1. Volume of cool air=9,300,000 CFM of air which includes defrost bank air to be dispersed via fans 11 (FIG. 1), duct or ducts 13 (FIG. 1) and plume(s) 15 (FIG. 1)
2. Select 50 BTU/hr $ft^2$ using FIG. 4 and project location by converting the Langleys shown on FIG. 4 to BTU/hr $ft^2$
3. Calculate solar insolation radius, $R_s$ (FIG. 1)=$1{,}416_{FT}$
4. Select 3,500 Ft/min as stack exit velocity $V_D$ (FIG. 1)
5. Calculate stack exit diameter $D_E$ (FIG. 2) using 1 stack per bank=33% feet
6. Select a terminal plume exit velocity at 16 (FIG. 1) of $$\frac{1}{10}$$

stack velocity $V_D$ (FIG. 2)

7. Determine stack+plume height 23 (FIG. 1)=$1{,}432_{FT}$
8. Calculate stack location distance $D_s$ 21 (FIG. 1)=354 feet using FIG. 3

It will be understood by those of ordinary skill that the temperature of the plume exit air, due to the nominal plume expansion cone angle (26, FIG. 2) would be less than $$\frac{1}{10}$$

of the 50° F. vaporizer air temperature drop or less than 5° F. below the surrounding air due to mixing within the rising plume and heat transfer from the surrounding air 17 (FIG. 1) and the rising plume surface 15 (FIG. 1) boundary layer 18 (FIG. 1).

As this example illustrates, the air temperature depression near the vaporizer array is removed; the potential for fog formation is reduced by plume mixing and warming, and the long term cooling effect caused by continuous operation is reduced due to the solar insolation area provided when applying the tenants of the invention.

The specification details the many features and advantages of the invention and thus it is intended by the appended claims to cover all such features and advantages. Since modifications and variations will occur such suitable modifications and equivalents may be resorted to falling within the scope of the invention.

LIST OF FIGURE NOTATIONS

1, 1C Ambient vaporizer(s)
2 Cryogenic inlet manifold
3 Vaporizer heat exchanger element
4 Top fluid manifold
5, 5C Entry warm air stream
5-1 Warm air stream boundary $$\text{Warm air stream boundary} = \frac{1}{10} \times \text{Entry Velocity at (5)}$$

Entry Velocity at (5)
6, 6C Vaporizer exit cold air
7 Open space
8, 8C Extended base
9 Containment barrier or wall
9-1 Containment barrier opening
10, 10A Vaporizer array
11, 11C Cold air discharge means, fan(s)
12 Air discharge duct
13,13C Air dispersal stack, chimney
14,14C Dispersal stack exit
14B Stack converging cone exit
15,15C Exhaust plume
16,16C Cold plume air exit
16-1 Geometric center solar insolation hemisphere
17, 17C Warm surrounding air
18 Rising plume boundary layer
19 Solar insolation hemisphere
20 Local solar insolation
21 Stack location distance, $D_S$
22 Cryogenic fluid/LNG/entering stream
23 Cold Plume Exit (16) distance from vaporizer base mount level (24)
24 Vaporizer base mounting level
25 Stack exit converging cone
26, 26C Plume expansion cone angle
27, 27A Induced air baffle or baffle deck
28C Air entry control duct
LNG Liquefied natural gas
NG Vaporized, warm natural gas
CFM Cubic feet per minute
$D_S$ Stack location distance (21)
$R_S$ Solar hemisphere radius
Π pi=3.14
$R_H$ Relative humidity
$D_E$ Stack exit diameter
$D_A$ Array equivalent hydraulic diameter
$V_D$ Stack exit velocity
$V_1$ Array air inlet stream velocity
$V_{D1}$ Stack converging cone exit velocity
$V_F$ Induced draft fan exit velocity
$GS_E$ Geometric Solar Radius center, FIG. 1 elevation view
$GS_p$ Geometric Solar Radius center, FIG. 1 plan view
BTU British Thermal Unit
$V_{PE}$ Plume exit velocity

What is claimed is:

1. A method of preventing or mitigating fog formation caused by the heating of a cryogenic fluid using an array of one or more ambient air vaporizers, said array arranged so as to define an open space at the bottom of said array of ambient air vaporizers, said array in turn having a vertically oriented containment barrier surrounding said open space, said barrier having a discharge passageway therethrough, said discharge passageway connected to an air discharge duct, said array of one or more ambient air vaporizers each comprised of a multiplicity of vertically oriented heat exchange elements, said elements in turn having tubular vertical passageways therethrough, said method comprising:

a) drawing a stream of warm surrounding ambient air into said array of one or more ambient air vaporizers wherein said ambient air is a heat source, then b) passing a cryogenic fluid through said tubular vertical passageways of said multiplicity of vertically oriented heat exchange elements, thereby c) cooling said stream of warm surrounding ambient air in heat transfer relationship with said cryogenic fluid as said stream of warm surrounding ambient air falls downward through said array of one or more ambient air vaporizers, and simultaneously d) heating said cryogenic fluid in heat exchange relationship with said stream of warm surrounding ambient air, then e) exiting the cooled stream of said warm surrounding ambient air at said bottom open space of said array of one or more ambient vaporizers, and then f) collecting said cooled air stream of said warm surrounding air within said vertically oriented containment barrier surrounding said open space at said bottom of said array of one or more ambient air vaporizers, and then g) discharging said collected cooled air stream through said discharge passageway of said vertically oriented containment barrier and passing into said air discharge duct, and then h) conducting said collected cooled air stream away from said discharge passageway, wherein said discharge passageway of said barrier is fitted with one or more air discharge means or fans, and wherein said air discharge duct extends a distance which is sufficient to have the cold exit of the plume of said cooled collected air to be at a distance from the geometric center of said array of one or more ambient vaporizers equal to the solar hemisphere radius ($R_S$) of the solar insolation input hemisphere of said array of ambient air vaporizers and as defined by:

$$\frac{\text{VAPORIZER ARRAY THERMAL DUTY}}{\text{LOCAL DAILY MEAN OF TOTAL SOLAR INSOLATION}} = \frac{1}{2}(4\pi R_S^2).$$

2. The method of claim 1, wherein said air discharge duct extends a lateral distance from said array and has a vertical chimney section attached thereto.

3. The method of claim 2 wherein the combined length of said air discharge duct lateral distance plus said vertical chimney section and the vertical cold air exhaust plume height or rise is such that the cold plume air exit of said cooled and collected air falls at or outside of said distance from said array geometric center equal to the solar hemisphere radius ($R_s$) as determined by the formula:

$$R_s = \frac{y_2}{8x} + \frac{x}{2}, \text{ wherein}$$

$R_s$ is said solar hemisphere radius, y is 2 times said vertical cold air exhaust plume height plus said height of said vertical chimney section, and x is the lateral length of said solar hemisphere radius $R_s$ minus said lateral distance of x is the lateral distance . . . said lateral distance of said air discharge duct.

* * * * *